US010165831B2

(12) United States Patent
Tsai et al.

(10) Patent No.: US 10,165,831 B2
(45) Date of Patent: Jan. 1, 2019

(54) SHOELACE

(71) Applicant: San Dai Enterprise Co., Ltd., Shengang Township, Changhua County (TW)

(72) Inventors: Chung-Yang Tsai, Shengang Township, Changhua County (TW); Ching-Fu Tsai, Shengang Township, Changhua County (TW)

(73) Assignee: San Dai Enterprise Co., Ltd., Changhua County (TW)

( * ) Notice: Subject to any disclaimer, the term of this patent is extended or adjusted under 35 U.S.C. 154(b) by 53 days.

(21) Appl. No.: 15/589,866

(22) Filed: May 8, 2017

(65) Prior Publication Data

US 2017/0367442 A1 Dec. 28, 2017

(30) Foreign Application Priority Data

Jun. 7, 2016 (TW) ..... 105208561 U

(51) Int. Cl.
*A43C 1/02* (2006.01)
*A43C 9/02* (2006.01)

(52) U.S. Cl.
CPC . *A43C 1/02* (2013.01); *A43C 9/02* (2013.01)

(58) Field of Classification Search
CPC ..... A43C 1/02; A43C 9/02; Y10T 24/3787
See application file for complete search history.

(56) References Cited

U.S. PATENT DOCUMENTS 6,513,210 B1 * 2/2003 Gonzalez ..... A43C 1/00 24/300
2014/0007392 A1 * 1/2014 Kajiwara ..... A43C 9/00 24/715.3

FOREIGN PATENT DOCUMENTS

EP 1795085 A1 * 6/2007 ..... A43C 1/02
FR 2971676 A1 * 8/2012 ..... A43C 1/02

* cited by examiner

*Primary Examiner* — Robert Sandy

(57) ABSTRACT

An improved shoelace has an elastic inner core having a plurality of elastic members and a woven string covering the elastic inner layer. The woven string has a plurality of narrow sections and wide sections evenly disposed on two ends of the elastic inner core. Each narrow section wraps around the elastic inner core, each wide section is longer than each narrow section and separated from the elastic inner core. When the elastic inner core is not pulled, the wide sections overlap and fold onto the elastic inner core 10 and has a cone shape with at least three times thickness than the narrow section. When the elastic inner core is pulled, the wide sections are stretched straight.

2 Claims, 5 Drawing Sheets

SHOELACE

BACKGROUND of INVENTION

1. Field of Invention

The present invention relates to a shoelace, and more particularly to an improved free-lacing shoelace.

2. Description of Related Art

Currently, a conventional free-lacing shoelace structure, as shown in FIGS. 8 and 9, when an axial stress is reduced on a resilient tensioning string 20, a plurality of stopper units 21 provided along the string 20 stick out; when the string is elongated due to tension, the outer diameter of each stopper unit 21 will be reduced, so that the string can pass through an opening. When the string is released from tension, the stopper unit 21 regains its outer diameter which can limit the movement of the string 20. But the concept of the above-described conventional still has following problems: the elastic cord 20 only partial contacts with the shoe body, therefore the frictional resistance between the elastic rope 20 and the shoe body is too low.

Therefore, it is desirable to provide a free-lacing shoelace to mitigate and/or obviate the aforementioned problems.

SUMMARY of INVENTION

An objective of present invention is to provide free-lacing shoelace.

In order to achieve the above mentioned objective, shoelace has an elastic inner core having a plurality of elastic members and a woven string covering the elastic inner layer. The woven string has a plurality of narrow sections and wide sections evenly disposed on two ends of the elastic inner core. Each narrow section wraps around the elastic inner core, each wide section is longer than each narrow section and separated from the elastic inner core. When the elastic inner core is not pulled, the wide sections overlap and fold onto the elastic inner core 10 and has a cone shape with at least three times thickness than the narrow section. When the elastic inner core is pulled, the wide sections are stretched straight.

Other objects, advantages, and novel features of invention will become more apparent from the following detailed description when taken in conjunction with the accompanying drawings.

DETAILED DESCRIPTION OF PREFERRED EMBODIMENT

Figure 1:
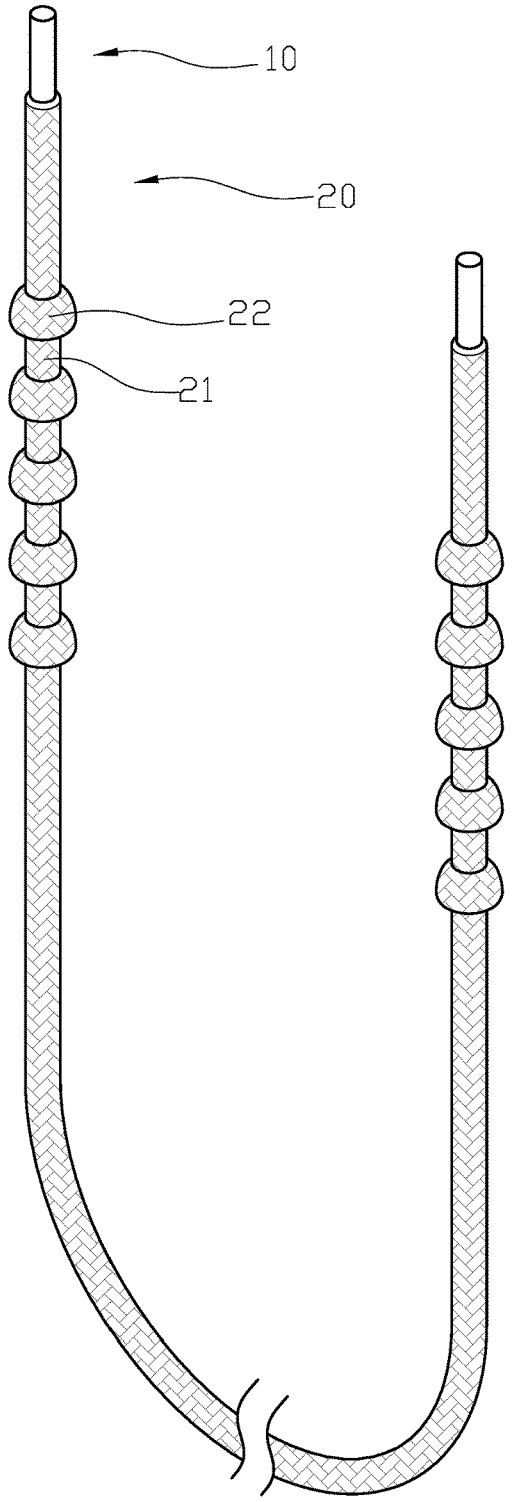
FIG. 1 is a perspective drawing of a preferred embodiment of the present invention.
Figure 2:
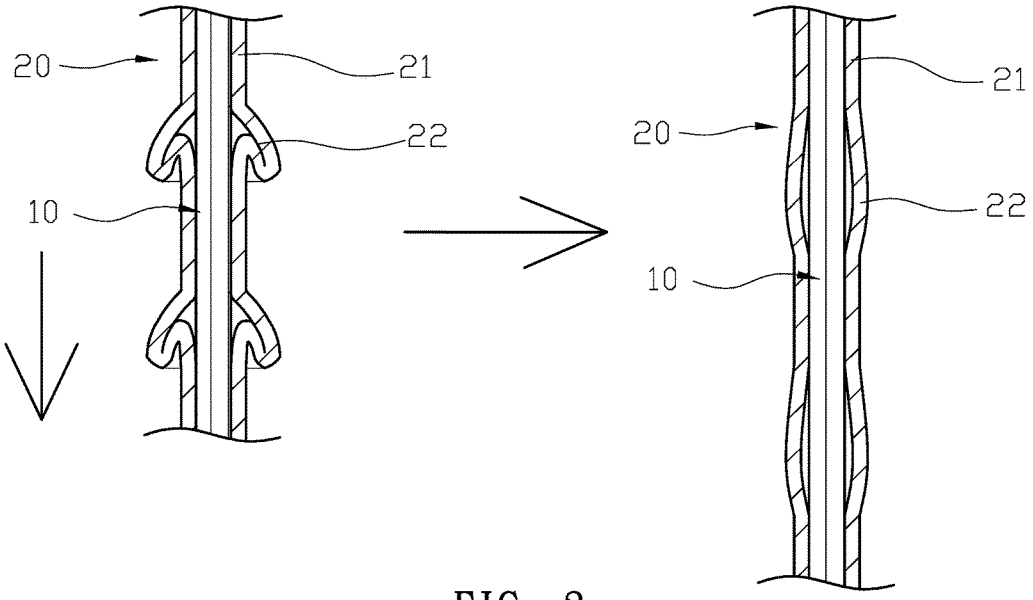
FIG. 2 is a cross-sectional drawing of a wide section according to the preferred embodiment of the present invention.
Figure 3:
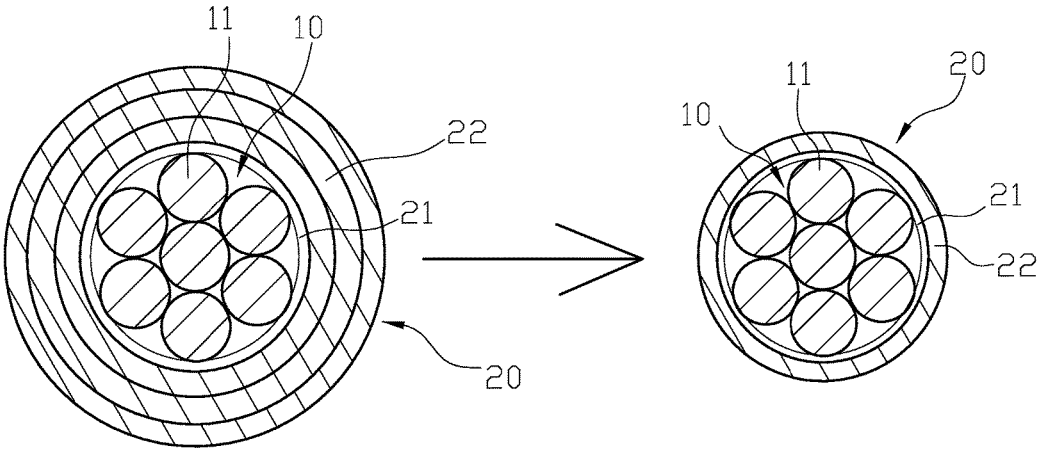
FIG. 3 is another cross-sectional drawing of a wide section according to the preferred embodiment of the present invention.
Figure 4:
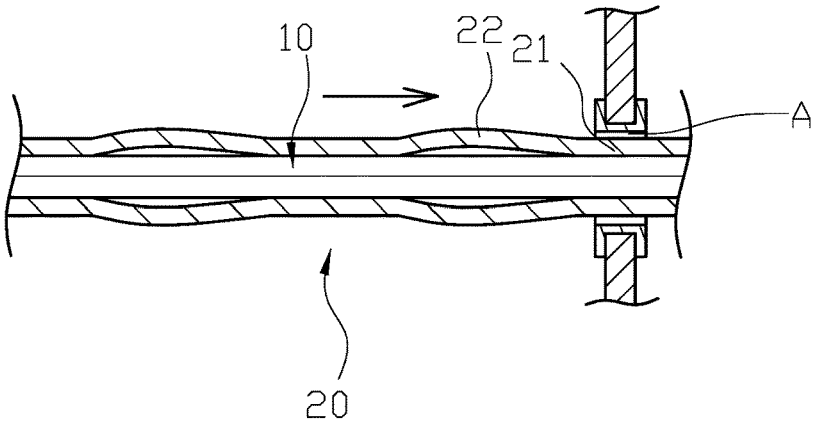
FIG. 4 is a schematic drawing of the improved shoelace on a shoe according to the preferred embodiment of the present invention.
Figure 5:
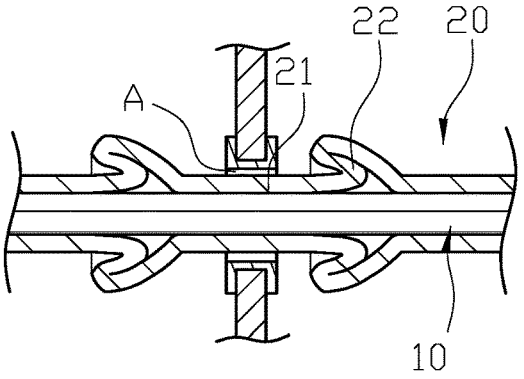
FIG. 5 is a schematic drawing of the narrow section passes through a shoelace hole according to the preferred embodiment of the present invention.
Figure 6:
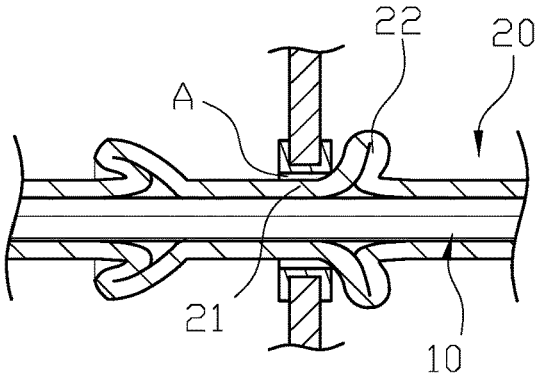
FIG. 6 is a schematic drawing of the wide section being limited according to the preferred embodiment of the present invention.
Figure 7:
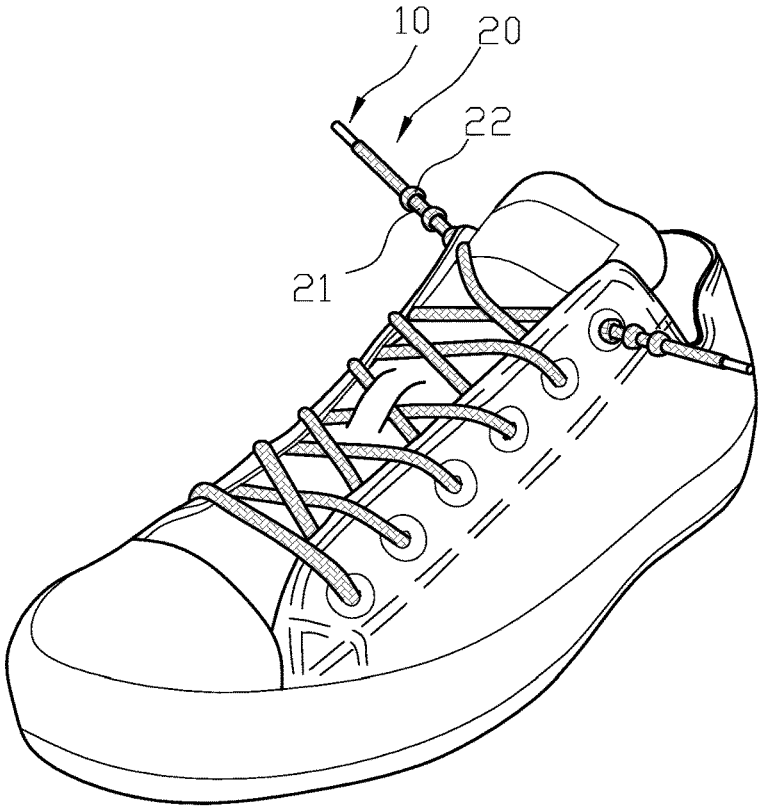
FIG. 7 is a schematic drawing of an actual operation according to the preferred embodiment of the present invention.
Figure 8:
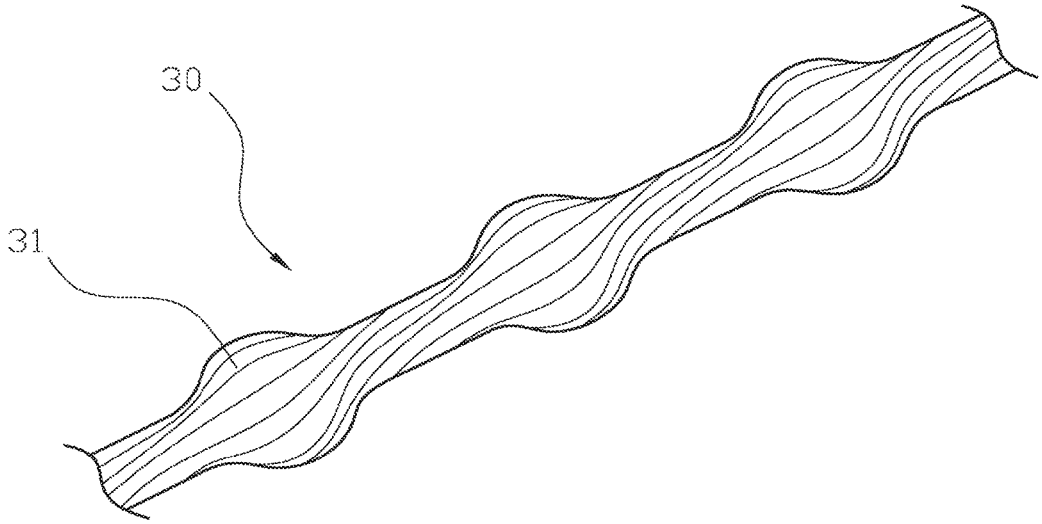
FIG. 8 PRIOR ART
FIG. 8 is a perspective drawing of a conventional shoelace.
Figure 9:
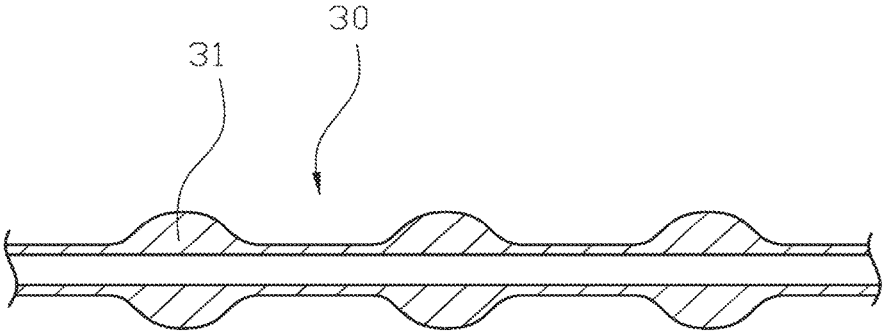
FIG. 9 PRIOR ART
FIG. 9 is a cross-sectional drawing of the conventional shoelace.

Please refer to FIG. 1, FIG. 2 and FIG. 3. An improved shoelace comprises an elastic inner core 10 having a plurality of elastic members and a woven string 20 covering the elastic inner layer 10. The woven string 20 has a plurality of narrow sections 21 and wide sections 22 evenly disposed on two ends of the elastic inner core 10. Each narrow section 21 wraps around the elastic inner core 10, each wide section 22 is longer than each narrow section 21 and separated from the elastic inner core 10. When the elastic inner core 10 is not pulled, the wide sections 21 overlap and fold onto the elastic inner core 10 and has a cone shape with at least three times thickness than the narrow section 21. When the elastic inner core 10 is pulled, the wide sections 22 are stretched straight.

For actual operation, please refer FIG. 4, FIG. 5, FIG. 6 and FIG. 7, the narrow section 21 of the woven string 20 wraps around the elastic inner core 10, the wide section 22 of the woven string 20 has the cone shape which can be strengthen out by pulling the elastic inner core 10. Therefore, the strengthen wide section 22 of the woven string 20 can easily pass a shoelace hole A, and when the elastic inner core 10 is released, the wide sections 22 with the cone shapes are limited at two sides of the shoelace hole A to hold the shoelace in place. The woven string 20 only has the plurality of the narrow sections 21 and wide sections 22 equally disposed on the two ends of the elastic inner core 10, which can eliminate the necessary of lacing the shoelaces.

With the above-mentioned structure follow benefits can be obtained: the shoelace has the elastic inner core 10 covered with the woven string 20 and the woven string 20 has the plurality of the narrow sections 21 and wide sections 22 equally disposed on the two ends of the elastic inner core 10. By pulling the shoelace, the wide sections 22 can be strength straight to pass through the shoelace hole A, then the narrow section 21 stays in the shoelace hole A and the wide section 22 restricts the movement of the shoelace.

Although the present invention has been explained in relation to its preferred embodiment, it is to be understood that many other possible modifications and variations can be made without departing from the spirit and scope of invention as hereinafter claimed.

What is claimed is:

1. An improved shoelace comprising an elastic inner core and a woven string covering the elastic inner layer; the woven string having a plurality of narrow sections and wide sections evenly disposed on two ends of the elastic inner core; each narrow section wrapping the elastic inner core, each wide section being longer than each narrow section and separated from the elastic inner core; wherein when the elastic inner core is not pulled the wide sections overlap and fold onto the elastic inner core, and when the elastic inner core is pulled, the wide sections are stretched straight.

2. The improved shoelace as claimed in claim 1, wherein the elastic inner core comprises a plurality of elastic members.

* * * * *